United States Patent [19]

Hirzel

[11] Patent Number: 5,010,629

[45] Date of Patent: Apr. 30, 1991

[54] PAPER CLIP WITH VERTICAL PANEL

[76] Inventor: Suzy C. Hirzel, 933 Shellwood Way, Sacramento, Calif. 95831

[21] Appl. No.: 457,948

[22] Filed: Dec. 27, 1989

[51] Int. Cl.[5] ..... B42F 1/02

[52] U.S. Cl. ..... 24/67.9; 24/547; 24/67 R

[58] Field of Search ..... 24/67.9, 67 R, 67.3, 24/67.11, 3 J, 545, 546, 547, 549

[56] References Cited

U.S. PATENT DOCUMENTS

| | | | |
|---|---|---|---|
| 1,809,689 | 6/1931 | Graves | 24/549 |
| 1,972,434 | 9/1934 | Yerk | 24/3 J |
| 2,184,569 | 12/1939 | Stewart | 24/67.9 |
| 2,768,416 | 10/1956 | McMullen | 24/547 |
| 2,910,749 | 11/1959 | Parker | 24/67.9 |
| 2,938,252 | 5/1960 | Scheemaeker | 24/547 |
| 3,168,954 | 2/1965 | von Herrmann | 24/67 R |
| 3,914,824 | 10/1975 | Purdy | 24/67.9 |
| 4,332,060 | 6/1982 | Sato | 24/67.9 |

FOREIGN PATENT DOCUMENTS

| | | | |
|---|---|---|---|
| 568514 | 6/1958 | Belgium | 24/67.9 |
| 978127 | 4/1951 | France | 24/67.9 |

*Primary Examiner*—Victor N. Sakran

[57] ABSTRACT

An improved clip with a neck that enables user to easily secure the thick gathered papers or the like without wrinkling or cramping. The clip having a vertical neck at the back of the clip, between the upper grip and lower panel, and lower panel is larger than the upper grip. Lower grip is flat and straight but upper grip is slanted. Front tip of the upper grip is almost the same level as the front tip of the lower panel and rear part of the upper grip is the same height as the top of the neck. The clip also has a rear solid portion having a back edge adapted to be pushed down by fingers. The clip will allow one to insert approximately ¼" to more than ½" papers or like material.

The shape of the clip is generally round at the front tip and generally straight at the rear end which is a handle portion. The upper grip may have an additional smaller grip and it can/may hold an additional layer of the paper or like.

The clip is made of one piece by plastic by injection molding and stamped metal sheet, or single wire.

5 Claims, 2 Drawing Sheets

PAPER CLIP WITH VERTICAL PANEL

FIELD OF THE INVENTION

This invention relates to clips, and more particularly to holding thick gathered papers or other similar materials without wrinkling. Also clip is able to hold more than two or three layers of items separately held together by one clip.

BACKGROUND OF THE INVENTION

During recent years, the use of paper clips has become increasingly more popular. Plastic clips which have pointed, rounded front shape with the large, smooth edges are well received. However, it can only hold very limited thickness of the gathered papers. U.S. Pat. No. 4,332,060, Hisao, Sato invented clips with spring action having vertical panel, which will hold up to half inch or more. The problem with these clips is that they are very expensively made, with more than two or three parts. Types usually having separate handles or springs are involved. These types are not only expensive, but they will stick out if in an envelope, which will be hard to mail, and needs a whole lot of strength close or open.

SUMMARY OF THE INVENTION

It is a general object of the present invention to provide a improved paper clip that will hold more than ¼" to ½" gathered paper or the like. Another object of the present invention is to provide affordable clips, which can be mailed out in an envelope. Also clip has smooth configuration, so it will not scratch the persons hand or wrinkle the paper. A further object of the present invention is to provide a improved paper clip having plural holding elements, which will permit, group together more than three or more gathered sheets separate and organized manner.

The clip can be made of plastic, single wire or stamped metal sheets.

The further features of the present invention are set forth in the following detailed description and accompanying drawings.

DETAILED DESCRIPTION

FIG. 1, 2, 3 and 4

Figure 1:
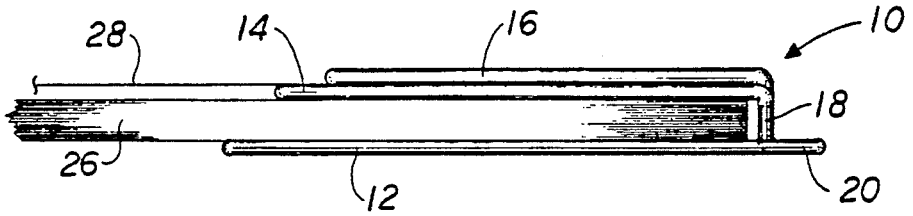
FIG. 1: is a side view of the first preferred embodiment of the improved clip showing with thick gathered paper.
Figure 2:
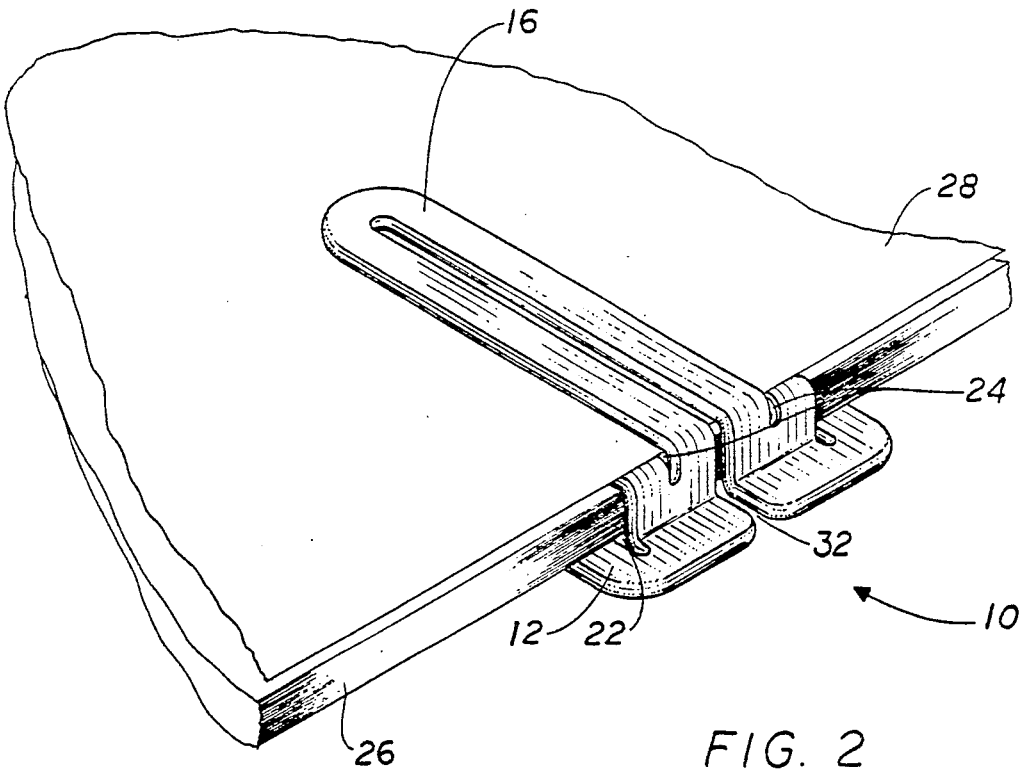
FIG. 2: is a perspective side-top view of the first preferred embodiment of the Improved clip showing the gathered papers and an additional paper on the top.
Figure 3:
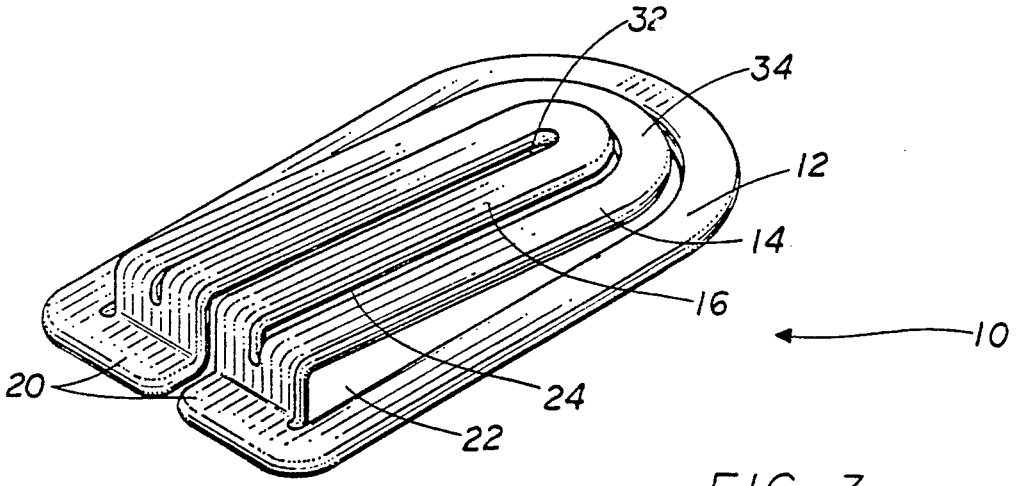
FIG. 3: is a perspective side-top view of the first preferred embodiment of the Improved clip.
Figure 4:
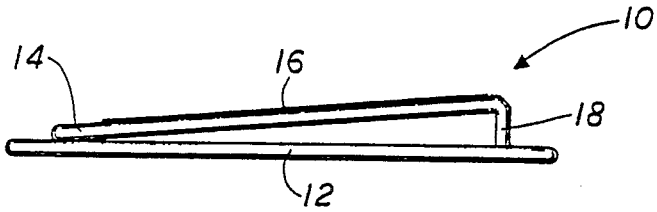
FIG. 4: is a side view of the first preferred embodiment of the Improved clip.

Referring more particularly to FIG. 1, 2, and 4, embodiment of the Improved paper clip with a a vertical panel [neck] is schematically depicted therein, thus, 10 is shown.

Clip 10 is comprised of lower panel 12, first upper grip 14, second upper grip 16. The neck 18 [vertical panel] is connected to rear finger pushing portion 20. Finger pushing portion 20 is necessary, to steady the clip by fingers when lifting grip 14. Grip 14/16 are slanted towards front and front-tip 34 is almost same level or may be even lower than the lower grip 12. This will produce a generally hollow triangular shape 30 [FIG. 4] from the side view of the clip. This method will allow the clip to hold the gathered papers 26 firmly.

Between the grip 14 and grip 16 having space 24, and grip 12 and 14 having space 22. Thick gathered papers or the like can be inserted into space 22, and another thinner layer of the paper 28 can be inserted into space 24 [FIG. 2]. Most of the time when people send documents, usually a letter is enclosed. This method will allow one to enclose the letter on the top and other thick gathered documents on the bottom. Also clip will be useful to hold together pages when reading books, and close files in the file cabinet or even put the paper money.

The neck length can be approximately as high as ⅛" to ½", and ¼" to ¾" wide. However, it can be shorter or higher and narrower or wider to accommodate to thicker or thinner to adjust.

Bottom clip 12 width and length may be from 1/12"to 5", and grip 14/16 are smaller than grip 12.

The space 24 may be extended to neck 18. This method will allow the paper to push all the way to the neck area.

Space 32 is located near the center of the clip 10. Space 32 is helpful to make the clip flexible and light weight.

FIG. 5 and 6

Figure 5:
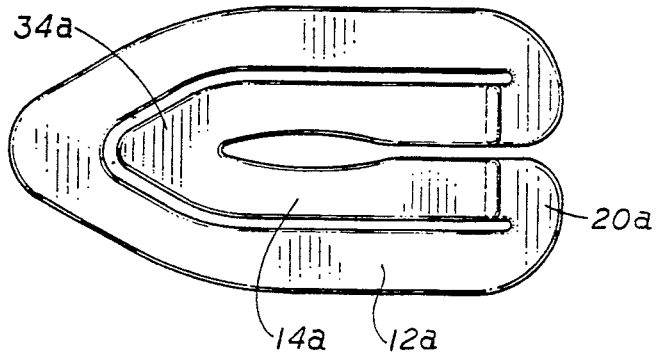
FIG. 5: is a top view of the second embodiment of the present invention.
Figure 6:
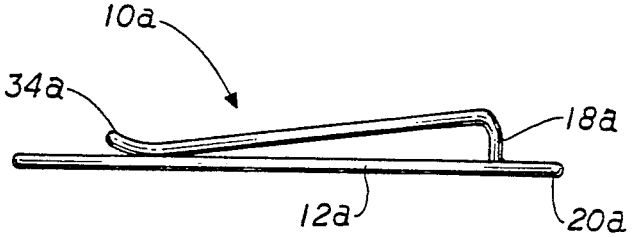
FIG. 6: is a side view of the second preferred embodiment of the Improved clip.

A second preferred embodiment of the Improved Clip with a Neck is shown in FIG. 4, 5 and 6. Clip **10*a* is similar to 10** and bear the same numerals, and are succeeded by the letter "a", except new numerals.

The clip **10*a* is identical to Clip 10** but simplified:

[A] The Clip **10*a* is comprised of lower panel 12*a*, upper grip 14*a* and space 22*a***.

Upper grip **14*a* can only hold the one layer of gathered paper or the like. Only one space 20*a*** can be used for insertion instead of multiple insertions.

[B] The front tip **34*a* is tipped upward for more pressure to the paper and easier to grip when opening the 14*a* from 12*a*** by the finger tips.

A third preferred embodiment of the Improved Clip **10*b*** is shown in

Figure 7:
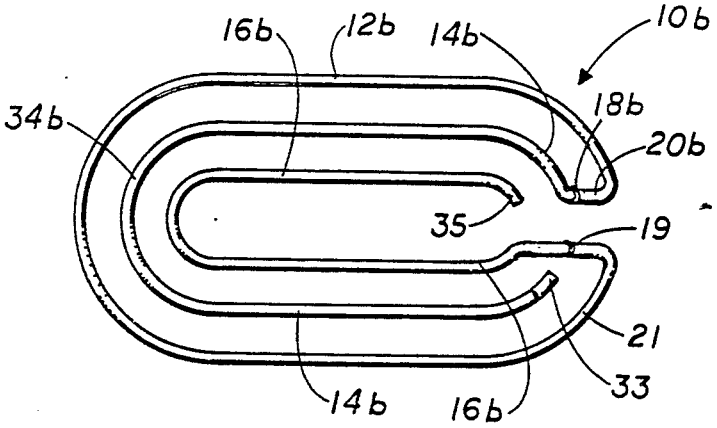
FIG. 7: is a top view of the third preferred embodiment of the Improved clip, made of single wire.

FIG. 7 FIG. 7. Clip **10*b* is similar to 10** and bear the same numerals, except new numerals.

[a] Clip **10*b*** is comprised of single wire.

[c] End of the wire 33 or 35 can be starting point. This case applicant will use end of wire 33 as starting point.

One of the wire end 33 will make the upper grip **14*b*, 14*b* having tip 34*b* and continuously connected vertical panel [neck] 18*b*, 18*b* becomes handle portion 20*b*, and 20*b* becomes 12*b*, 12*b* is continuously connected to handle 21 and neck 19. Neck 19 will becomes 16*b* and will end, ending point 35**.

The Improved clip can be made of plastic or metal. The thickness of the clip depends on the material. If metal is used, spring metal would be desirable, because it will always return to its original form. Metal Clips can be stamped or dye cut or, made of single wire. Plastic can be injection molded in various colors to identify and organize the sizes, etc.

Various modifications, changes, alterations and additions can be made in the Improved Clip with a Neck of the present invention, its components and their parameters. All such modifications, changes, alterations and additions as are within the scope of the appended Claims form part of the present invention.

Accordingly, Improved Clip with a Neck is efficient, inexpensive and durable. It is of novel configuration and utility.

What is Claimed is:

1. An Improved Clip with a Neck comprising: Upper, middle and lower horizontal panels having front, side and back, with a generally vertical neck having bottom and top surface, said bottom surface is connected to said lower panel, said top surface is connected to said middle panel, said lower panel is larger than said middle panel, and said middle panel is larger than the upper panel, the front tip of said upper and middle panels are tapered for easy insertion of objects, said lower panel back is connected to horizontal base, said base is adapted to be pushed down by finger(s) to steady said clip while said panels are opened for loading of objects, said lower and middle panels having a vertical gap therebetween, said gap is greater at the back of he panel area than the front panel area when said panels are not in use, said upper panel and middle panel are in the same plane, said lower and middle panel accomodate thicker object therebetween than between said middle and upper panels, said lower panel is generally in a straight line, said clip is made of one piece, said clip is longer in length form front to back than from side to side, wherein said upper panels, neck, and base having a single slot for flexibility and minimumizing the total weight of the clip.

2. The Clip with Neck of claim 1 wherein said middle panel front is generally at the same plane as lower panel front or possibly lower for added pressure.

3. The Clip with a Neck of claim 1 wherein said middle panel front (tip) may be slightly raised for easy opening for insertion of objects in one of the embodiments.

4. The Clip with a Neck of claim 1 wherein said clip is made by injection molding in one of the embodiments.

5. The Clip with a Neck of claim 1 wherein said wherein said clip is made of a single wire and said single wire is made of spring metal in one of the embodiments.

* * * * *